United States Patent [19]

Ishii

[11] Patent Number: 4,789,854

[45] Date of Patent: Dec. 6, 1988

[54] COLOR VIDEO DISPLAY APPARATUS

[75] Inventor: Takatoshi Ishii, Tokyo, Japan

[73] Assignee: ASCII Corporation, Tokyo, Japan

[21] Appl. No.: 526

[22] Filed: Jan. 5, 1987

[30] Foreign Application Priority Data

Jan. 14, 1986 [JP] Japan ..... 61-5800

[51] Int. Cl.[4] ..... G09G 1/28

[52] U.S. Cl. ..... 340/703; 340/701; 340/721; 340/734; 340/800; 358/22

[58] Field of Search ..... 340/703, 701, 721, 734, 340/745, 750, 799, 800; 358/22, 21 R, 903, 310

[56] References Cited

U.S. PATENT DOCUMENTS

| | | | |
|---|---|---|---|
| 4,314,357 | 2/1982 | Kimura et al. | 340/779 |
| 4,459,677 | 7/1984 | Porter et al. | 340/750 |
| 4,498,081 | 2/1985 | Fukushima et al. | 340/799 |
| 4,498,098 | 2/1985 | Stell | 358/310 |
| 4,665,438 | 5/1987 | Morin et al. | 358/22 |
| 4,686,521 | 8/1987 | Beaven et al. | 340/703 |
| 4,712,099 | 12/1987 | Maeda | 340/799 |

FOREIGN PATENT DOCUMENTS

| | | | |
|---|---|---|---|
| 2143106 | 1/1985 | United Kingdom | 340/703 |
| 2167926 | 6/1986 | United Kingdom | 340/703 |

*Primary Examiner*—John W. Caldwell, Sr.
*Assistant Examiner*—Edwin C. Holloway, III
*Attorney, Agent, or Firm*—Hoffmann & Baron

[57] ABSTRACT

A color video display apparatus displays a first image represented by luminance and color difference data stored in a VRAM and a second image represented by color codes stored in the same VRAM on a screen of a CRT display unit in a superimposed relation. Each address of the VRAM stores the luminance data and an attribute bit of the corresponding display dot of the first image, and the color difference data is formed with respect to each group of a predetermined number of display dots of the first image and stored in a predetermined number of addresses of the VRAM. The color code of each dot of the second image is stored in the corresponding addresses of the VRAM. The data sequentially read from the addresses of the VRAM are shifted into a register group composed of a predetermined number of registers. Data contained in specific bits of the registers is transferred to another register each time the predetermined number of data are read from the VRAM, and is outputted from the another register as the color difference data. When the attribute bit contained in specific one of the registers of the register group is "0", color data representative of a color of the corresponding display dot is formed from the luminance data contained in the specific register and the color difference data contained in the another register. On the other hand, when the attribute bit contained in the specific register is "1", the color data is formed by a look-up table from the color code contained in the specific register.

9 Claims, 7 Drawing Sheets

COLOR VIDEO DISPLAY APPARATUS

BACKGROUND OF THE INVENTION

1. Field of the Invention

The present invention relates generally to a color video display apparatus, and more particularly to a color video display apparatus which is well suited for displaying a picture in which a given image can be superimposed on a natural image displayed with fine gradation.

2. Prior Art

A typical form of color display has heretofore been well known in which a VRAM (video RAM) is arranged to store R (red), G (green) and B (blue) color data in correspondence with each dot of an image to be displayed, such color data being read out and converted into R, G and B color video signals and outputted to a CRT display unit.

In general, a natural image must be displayed with fine gradation. However, in order to achieve such fine gradation image display, the number of bits corresponding to the respective R, G and B color data, which represent a color of one display dot, must be at least 4 to 8 for each data, that is, 12 to 24 bits in total for each display dot. If the number of bits corresponding to each color data is increased, the capacity of the VRAM must also be increased. To solve this problem, if the VRAM is arranged to store luminance data Dy and color difference data Du and Dv instead of the R, G and B color data, the capacity of the VRAM can be reduced approximately to a half as compared with the case where the color data are stored. As is well known, if the R, G and B color data are represented respectively by Dr, Dg and Db, the luminance data Dy and the color difference data Du and Dv can be calculated by the following equations:

$$Dy = 0.30\,Dr + 0.59\,Dg + 0.11\,Db \quad (1)$$

$$\begin{aligned} Du &= Dr - Dy \\ &= 0.70\,Dr - 0.59\,Dg - 0.11\,Db \end{aligned} \quad (2)$$

$$\begin{aligned} Dv &= Db - Dy \\ &= -0.30\,Dr - 0.59\,Dg + 0.89\,Db \end{aligned} \quad (3)$$

If the VRAM is arranged to store the aforementioned luminance data Dy and the color difference data Du and Dv instead of the color data, the capacity of the VRAM can be reduced. The reason why such reduction can be achieved is as follows. The human eye generally has a characteristic that a color of an image can not be identified when an area of the image become sufficiently small. Therefore, when a color image is to be displayed, data representative of color differences of dots of the color image can be outputted at a low speed. In this case, although the luminance data Dy need be provided for each dot of the color image, the color difference data Du and Dv need not be provided for each dot. For example, it is sufficient to provide a single averaged color difference data for each series of four dots. More specifically, if the data Dy, Du and Dv are constituted respectively by four bits, the capacity of the VRAM required to display four dots is equivalent to 24 bits as shown in FIG. 1-(*a*). In FIG. 1-(*a*), the data Dy is stored along the vertical axis, while the data Du and Dv are stored along the horizontal axis. In contrast, if the color data Dr, Dg and Db are constituted respectively by four bits, 48 bits are needed to display a set of four dots, as shown in FIG. 1-(*b*).

Thus, it is possible to significantly reduce the storage capacity of the VRAM by storing display data corresponding to each display dot in the form of the luminance data Dy and the color difference data Du and Dv. In this case, however, one problem arises in connection with the displaying of superimposed images. More specifically, in the field of computer graphics, there are cases where a first image is used as a background image and a second image is superimposed on the first image, such combined image being displayed on a screen. In this case, if the first image is stored in the form of R, G and B color data, the second image can be superimposed on the first image by merely rewriting those color data in the VRAM which correspond to the second image, since each display dot directly corresponds to a respective one of the color data stored in the VRAM. However, in the case where the first image is stored in a compressed manner using the luminance and color difference data, a set of color difference data are stored in correspondence with each group of a plurality of display dots, and this makes it difficult to rewrite the color difference data on a one-display-dot unit basis. More specifically, the read/write control of data with respect to the VRAM in the case where the color data are used is different from that in the case where the luminance data and the color difference data are used. With the prior art circuit arrangements, it has therefore been difficult to store those different data in a mixed manner. In this case, although it is, of course, not very difficult to rewrite those data in a unit composed of a plurality of dots, such rewriting method lowers the resolution of the second image.

On the other hand, the following prior art construction is known as one construction which enables a second image to be superimposed on a first image which is stored in a compressed manner using the luminance and color difference data. In FIG. 2, the prior art construction includes a CPU (central processing unit) 1, a bus line 2, a display controller 3, a first VRAM 4, a converter 5, a selector 6, a second VRAM 7, a look-up table (LUT) 8 and a digital-to-analog converter (DAC) 9. Data representative of the first image is written into the first VRAM 4 in the form of the luminance and color difference data, and these data are sequentially read out of the VRAM 4 by the display controller 3, being converted into the R, G and B color data by the converter 5, and being outputted to the selector 6. A color code representative of the color of each dot constituting the second image is written into the second VRAM 7 in correspondence with each dot to be displayed, and "0"s are written into all areas except those corresponding to the second image within the VRAM 7. The contents of the VRAM 7 are sequentially read out in synchronism with the timings at which data are read from the VRAM 4, and are outputted to the look-up table 8. When the second VRAM 7 outputs the color code to the look-up table 8, the look-up table 8 converts this color code into the R, G and B color data, outputs them to the selector 6 and supplies a signal CS representative of "1" to the same. On the other hand, when the second VRAM 7 outputs a "0" to the look-up table 8, the look-up table 8 outputs the signal CS of "0" to the selector 6. When the signal CS is "1", the selector 6 outputs to the DAC 9 the color data supplied from the look-up table 8, whereas when the signal CS is "0", the selector 6 outputs to the DAC 9 the color data supplied from the converter 5. The DAC 9 converts the color data fed from the selector 6 into the R, G and B color video signals (in analog form) and supplies them to the CRT display unit (not shown).

With this arrangement, it is possible to freely superimpose one image on another by rewriting the color codes in the VRAM 7. This arrangement is, however, disadvantageous in that since the VRAM 7 must be provided additionally, the required memory capacity is significantly increased.

SUMMARY OF THE INVENTION

It is therefore an object of the present invention to provide a color display apparatus in which a color image is displayed on the basis of the luminance and color difference data stored in a VRAM, and in which images can be superimposed on one another with a minimum of memory capacity and with a simple circuit arrangement.

It is another object of the present invention to provide a color display apparatus which has the above-described construction, and in which a second image can be superimposed on a first image without damaging the resolution thereof.

According to an aspect of the present invention, there is provided a color video display apparatus for displaying a color image composed of a plurality of display dots on a screen of a display unit comprising:

(a) video information storage means having a plurality of memory locations each corresponding to a respective one of the plurality of display dots; each of the memory locations storing one of first display information and second display information both relating to a respective one of the display dots and attribute information representing whether the one of the first and second display information is the first display information or the second display information; the plurality of memory locations being divided into a plurality of groups each composed of a predetermined number of memory locations for storing third display information relating to corresponding ones of the plurality of display dots;

(b) reading means for sequentially accessing the plurality of memory locations in synchronism with display timings of the display dots to read from each of the plurality of memory locations information stored therein;

(c) color data generating means responsive to each information read by the reading means for generating color data representative of a color of the corresponding display dot based on the first and third display information contained in each read information when the attribute information of each read information represents the first display information, the color data generating means generating the color data based on the second display information contained in each read information when the attribute information of each read information represents the second display information; and (d) signal feeding means for feeding a signal corresponding to the color data to the display unit.

According to another aspect of the present invention, there is provided a display control circuit for use with a display unit which displays a color image composed of a plurality of display dots on a screen thereof in response to display signals formed in accordance with color data comprising an input terminal for being sequentially supplied, in synchronization with display timings of the display dots, display data each of which includes one of first display information and second display information both relating to the corresponding display dot and attribute information representing whether the one of the first and second display information is the first display information or the second display information, the first display information including a part of first information relating to the corresponding display dot and second information relating to the corresponding display dot; a register group including a plurality of registers for respectively storing, in synchronization with the display timings, a predetermined number of the display data supplied to the input terminal; temporary storage means for storing the first information contained in the register group each time all parts of the first information are stored in the register group; first conversion means for converting the second information contained in a specific one of the registers of the register group and the first information stored in the temporary storage means into first color information; and data selection means for outputting the first color information as the color data when the attribute information contained in the specific register represents the first display information, and for outputting the second display information contained in the specific register when the attribute information contained in the specific register represents the second display information.

BRIEF DESCRIPTION OF THE DRAWINGS

FIG. 1-(*b*) is an illustration showing an arrangement of color data Dr, Dg and Db stored in a VRAM of a prior art color video display apparatus;

DESCRIPTION OF THE PREFERRED EMBODIMENTS OF THE INVENTION

A preferred embodiment of the present invention will now be described below with reference to the accompanying drawings.

Figure 1:
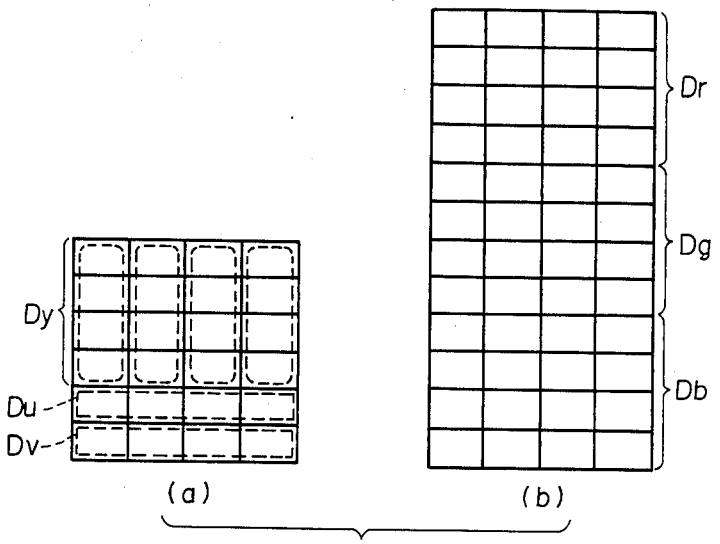
FIG. 1 (PRIOR ART)
FIG. 1-(*a*) is an illustration showing an arrangement of luminance data Dg and color difference data Du and Dv stored in a VRAM of a prior art color video display apparatus.
Figure 2:
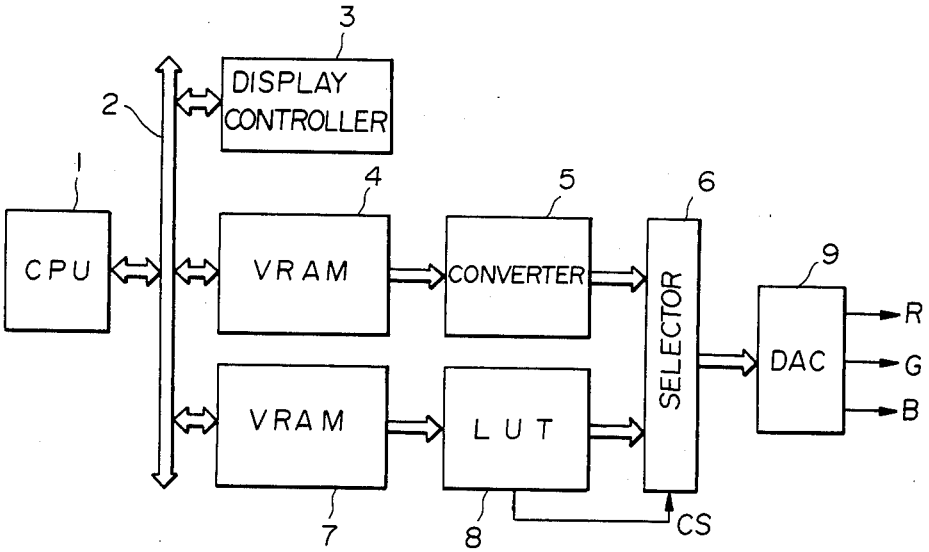
FIG. 2 (PRIOR ART)
FIG. 2 is a block diagram of a color video display apparatus provided in accordance with the prior art.
Figure 3:
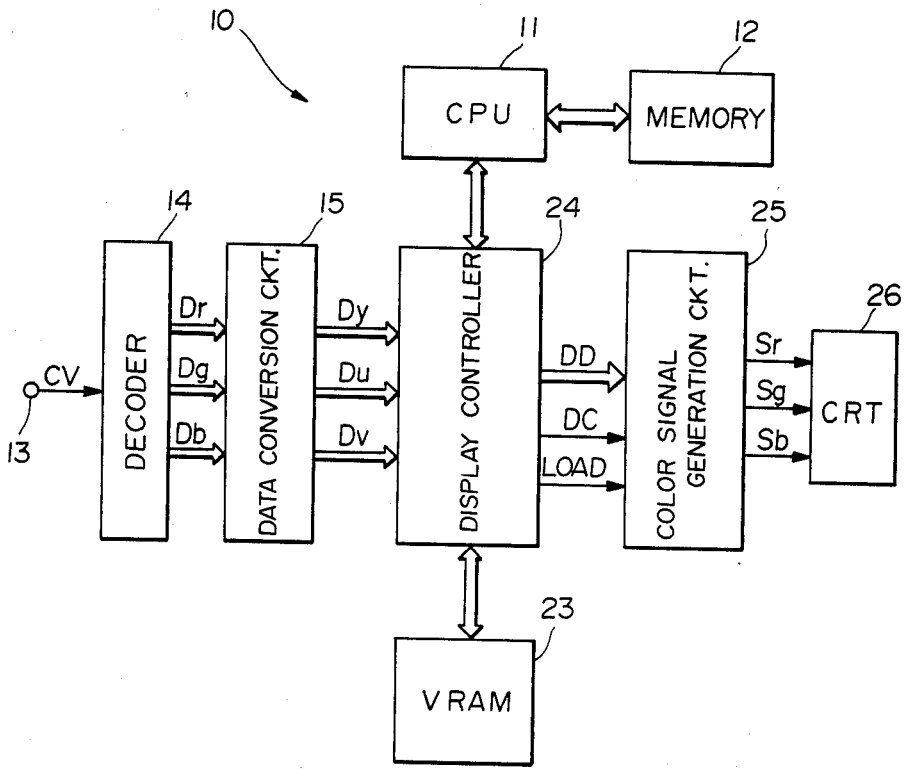
FIG. 3 is a block diagram of a color video display apparatus 10 constituting a first preferred embodiment of the present invention.

FIG. 3 is a block diagram of a color video display apparatus 10 constituting the preferred embodiment of the present invention. The color video display apparatus 10 is capable of displaying an image such as a natural image on the basis of a composite video signal CV supplied from the exterior of the apparatus 10, and is also capable of displaying another image so as to be superimposed on the first-mentioned image.

As shown in FIG. 3 the color video display apparatus 10 comprises a CPU 11 and a memory 12 which includes a ROM for storing programs to be used by the CPU 11 and a RAM for storing data. The color video display apparatus 10 further comprises a terminal 13 through which the composite video signal CV is inputted; a conventional decoder 14 for decoding the composite video signal CV into the color data Dr (red), Dg (green) and Db (blue); and a conversion circuit 15 for converting the color data Dr, Dg and Db into luminance data Dy and two color difference data Du and Dv.

The data conversion circuit 15 is the circuit in which data conversion is effected on the basis of the previously described equations (1), (2) and (3), and the following description concerns an example of the structure of the circuit 15.

The previously described equation (1) can be represented by the following approximate equation:

$$Dy=(9/32)Dr+(9/16)Dg+(\tfrac{1}{8})Db \quad (4)$$

The equation (4) can be transformed into the following equation:

$$Dy=(1/16)(8Dg+4Dr+2Db+Dg+Dr/2) \quad (5)$$

As will be evident from the equation (5), the luminance data Dy can be obtained by adding (i) data obtained by shifting upwardly the color data Dg by three bits, (ii) data obtained by shifting upwardly the color data Dr by two bits, (iii) data obtained by shifting upwardly the color data Db by one bit, (iv) the color data Dg, and (v) data obtained by shifting downwardly the color data Dr by one bit, together. As a result of the luminance data Dy being obtained, the color difference data Du and Dv can be easily obtained from the previously noted equations (2) and (3).

As will be appreciated from the foregoing, the data conversion circuit 15 can be easily constructed by combining shift circuits, adders and subtracters.

Figure 4:
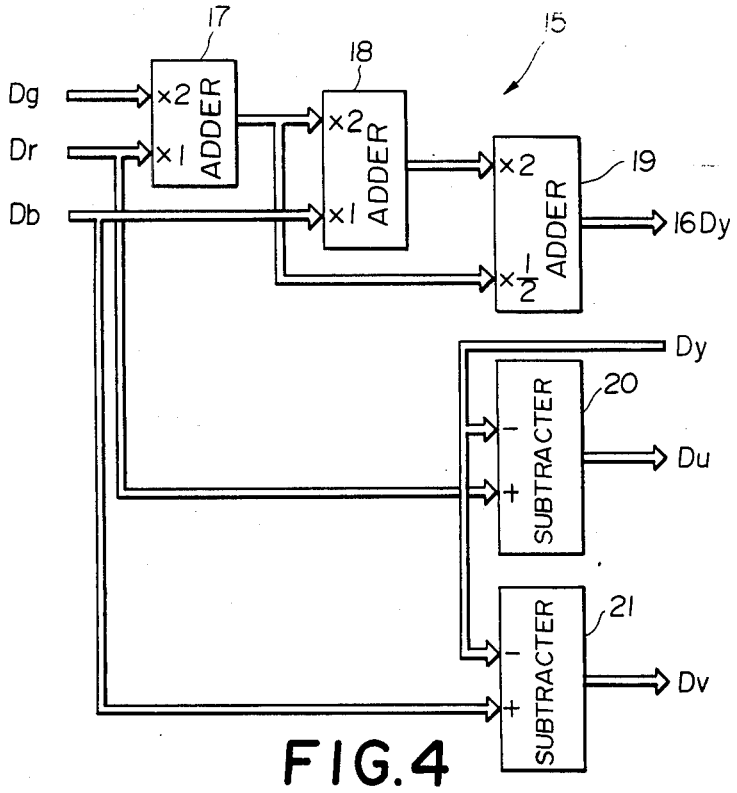
FIG. 4 is a block diagram of the data conversion circuit 15 incorporated in the color video display apparatus 10 of FIG. 3.

FIG. 4 is a circuit diagram of an example of the data conversion circuit 15 which includes adders 17, 18 and 19 and subtracters 20 and 21. The symbol "X2" marked at one input terminal of each of the adders 17, 18 and 19 represents that the data inputted to the input terminal thereof is doubled before being subjected to an addition operation. Actually, the input data is first shifted upwardly by one bit and is then applied to the input terminal. Similarly, the symbol "X1/2" represents that the input data is first shifted downwardly by one bit and is then applied to the input terminal.

As can be seen from FIG. 4, the data conversion circuit 15 performs the following operations:

$$\begin{aligned} Dy &= 2[2(2\,Dg + Dr) + Db] + (\tfrac{1}{2})(2\,Dg + Dr) \\ &= (9/2)[Dr + 2\,Dg + (4/9)Db] \end{aligned} \quad (6)$$

$$Du = Dr - Dy \quad (7)$$

$$Dv = Db - Dy \quad (8)$$

On the other hand, the previously noted equation (4) can be modified as follows:

$$Dy=(9/32)[Dr+2Dg+(4/9)Db] \quad (9)$$

As will be appreciated from the equations (6) and (9), approximate values of the data Dy, Du and Dv can be obtained by the circuit shown in FIG. 4.

Figure 5:
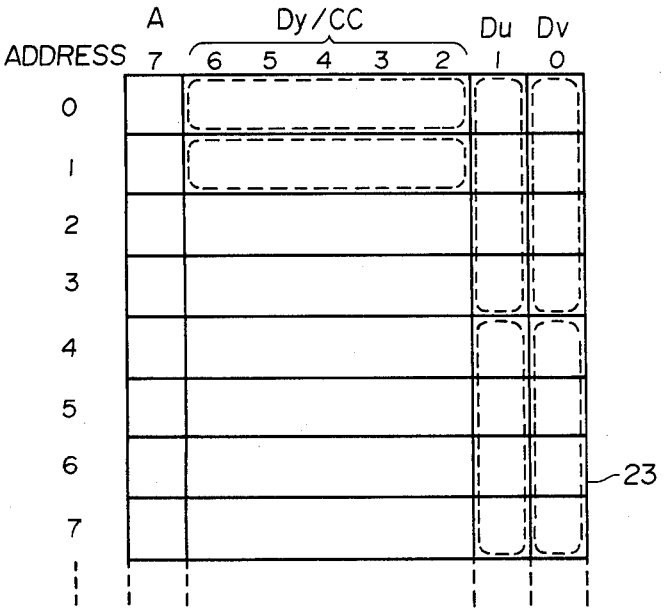
FIG. 5 is an illustration showing the arrangement of the luminance data Dy, the color difference data Du and Dv and color codes CC stored in the VRAM 23 of the color video display apparatus 10 of FIG. 3.

The color video display apparatus 10 of FIG. 3 further comprises a VRAM 23 which is constituted by eight pieces of dynamic RAMs connected to each other in a parallel fashion and each capable of effecting reading/writing of data on a one-bit unit basis. FIG. 5 shows the format of the data stored in the VRAM 23. The VRAM 23 is divided into a plurality of addresses on an eight-bit unit basis, and each address corresponds to a respective one of the display dots. The 0th bit of each address stores one of the bits of the corresponding color difference data Dv, the first bit stores one of the bits of the corresponding color difference data Du, the second to sixth bits store all bits of the corresponding luminance data Dy or the corresponding color code CC (both composed of five bits), and the seventh bit stores an attribute bit A. In this case, the color difference data Du and Dv are stored using a series of four addresses, while the luminance data Dy, the color code CC and the attribute bit A are stored in each address.

Figure 6:
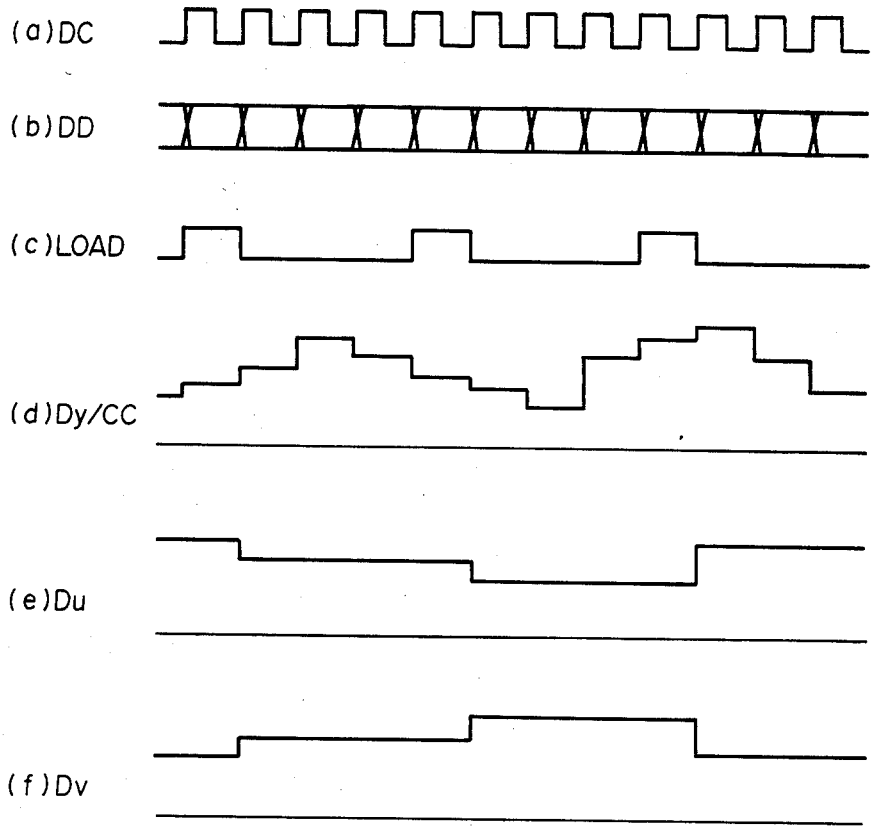
FIG. 6 is a timing chart showing variations of various signals and data appearing in the color video display apparatus 10 of FIG. 3.

The color video display apparatus 10 of FIG. 3 further comprises a display controller 24 for effecting the writing/reading of data into/from the VRAM 23. The display controller 24 writes the data Dy, Du and Dv supplied from the data conversion circuit 15 into the VRAM 23 in the format shown in FIG. 5, and at the same time writes the attribute bit A of "0" into the VRAM 23. When one image is to be superimposed on another image, the display controller 24 writes a color code CC supplied from the CPU 11 into the second to sixth bits of the address designated by address data supplied from the CPU 11. Simultaneously, the display controller 24 writes the attribute bit A of "1" into the seventh bit of the address into which the color code CC has been written. Also, when a display command is supplied from the CPU 11, the display controller 24 sequentially reads data from the addresses of the VRAM 23, supplying each of the read data to a color signal generation circuit 25 as dot display data DD, and at the same time outputting a dot clock DC and a load signal LOAD to the circuit 25. FIG. 6-(*a*) shows the waveform of the dot clock DC, and FIG. 6-(*b*) shows the variation of the dot data DD. As shown in FIGS. 6-(*a*) and 6-(*b*), the dot data DD are outputted in synchronism with the dot clock DC. The dot clock DC is a clock which has a frequency corresponding to the timing of display of the dots on the CRT display unit 26. FIG. 6-(*c*) shows the waveform of the load signal LOAD. As shown in FIG. 6-(*c*), the load signal LOAD is outputted every four cycles of the dot clock signal DC.

The color signal generation circuit 25 generates R, G and B analog color video signals Sr, Sg and Sb based on the dot display data DD fed from the display controller 24, and supplies them to the CRT display unit 26 of the conventional type. As shown in detail in FIG. 7, the color signal generation circuit 25 comprises 8-bit parallel-in/parallel-out registers 28 to 31 for storing, in response to the dot clock DC, the data DD fed through an input terminal T from the display controller 24, and a 6-bit parallel-in/parallel-out register 32 similar in structure to the registers 28 to 31. Shown at 33 is an 8-bit parallel-in/parallel-out register which stores data supplied to its input terminal when the dot clock DC and the load signal LOAD are simultaneously supplied. In operation, the dot display data DD outputted from the display controller 24 is first stored into the register 28, and is then shifted in the order of the registers from 29 to 31. Subsequently, the higher-order 6 bits of the display data DD in the register 31, that is, the attribute bit A and the luminance data Dy (or the color code CC), are stored into the register 32 in response to the dot clock DC. The attribute bit A stored in the register 32 is supplied to a selection terminal SEL of a selector 35, while the luminance data Dy (or the color code CC) stored in the register 32 is supplied in parallel to both of a look-up table 36 and a data conversion circuit 37. Each time the lower-order two bits of the dot display data DD (i. e., the color difference data Du and Dv) are stored in the registers 28 to 31 in a four-bit unit, these bits are transmitted to the register 33. The color difference data Du and Dv thus transmitted to the register 33 are outputted to the data conversion circuit 37.

FIG. 6-(*d*) shows the variation in value of the luminance data Dy (or the color code CC) outputted from the register 32, and FIGS. 6-(*e*) and 6-(*f*) show the variations of the color difference data Du and Dv, respectively. As shown in FIGS. 6-(*e*) and 6-(*f*), the color difference data Du and Dv change their states every four cycles of the dot clock DC.

Referring again to FIG. 7, the look-up table 36 is a known circuit which converts the color code CC fed from the register 32 into the R, G and B color data Dr, Dg and Db and outputs these color data to the selector 35. The data conversion circuit 37 converts the luminance data Dy and the color difference data Du and Dv fed from the registers 32 and 33 into the R, G and B color data Dr, Dg and Db and outputs these color data to the selector 35.

The data conversion circuit 37 will now be more fully described hereunder.

First, the following equations are obtained from the previously noted equations (1) and (3):

$$Dg = Dy - 0.51Du - 0.19Dv \quad (10)$$

$$Dr = Dy + Du \quad (11)$$

$$Db = Dy + Dv \quad (12)$$

The above equation (10) can be represented by the following approximate equation:

$$Dg = Dy - (\tfrac{1}{2})Du - (\tfrac{1}{4})Dv \quad (13)$$

This equation (13) can be modified to obtain:

$$\begin{aligned} Dg &= (\tfrac{1}{4})(4\,Dy - 2\,Du - Dv) \\ &= (\tfrac{1}{4})[2(2\,Dy - Du) - Dv] \end{aligned} \quad (14)$$

Figure 8:
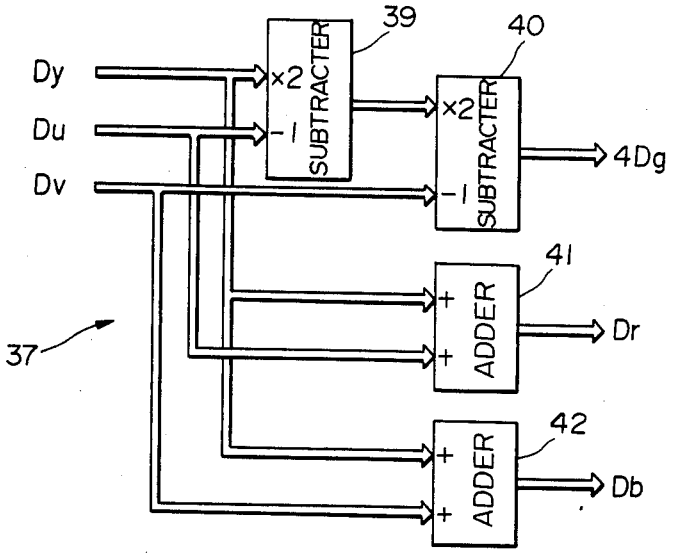
FIG. 8 is a block diagram of the data conversion circuit 37 incorporated in the color signal generation circuit 25 of FIG. 7.

It will be understood from the equation (14) and the previously noted equations (11) and (12) that the data conversion circuit 37 may be constructed as shown in FIG. 8. The data conversion circuit 37 shown in FIG. 8 includes subtracters 39 and 40 and adders 41 and 42. The symbol "X2" marked at each of the subtracters 39 and 40 represents that the input data is shifted upwardly by on bit.

When the attribute bit A of "1" is supplied to the selection terminal SEL of the selector 35 (FIG. 7), that is, when the color code CC is outputted from the register 32, the selector 35 selects the R, G and B color data Dr, Dg and Db fed from the look-up table 36 to input terminals <1>thereof and supplies these selected color data respectively to the DACs (digital-to-analog converters) 44, 45 and 46. On the other hand, when the attribute bit A is "0", that is, when the luminance data Dy is outputted from the register 32, the selector 35 selects the R, G and B color data Dr, Dg and Db fed from the data conversion circuit 37tto input terminals <0>thereof and supplies the thus selected data to the corresponding DACs 44, 45 and 46. The DACs 44 to 46 convert the R, G and B color data Dr, Dg and Db fed from the selector 35 respectively into the analog color video signals Sr, Sg and Sb, and supplies these signals Sr, Sg and Sb to the CRT display unit 26 (FIG. 3). The CRT display unit 26 displays each color dot in accordance with the color video signals Sr, Sg and Sb. Although not shown in the drawings, the display controller 24 generates a synchronization signal required to display each dot and supplies it to the CRT display unit 26.

The above-described embodiment is arranged such that when a second image is to be superimposed on a first image, the color codes corresponding to the second image are written into the VRAM 23. The embodiment may however be modified so that the color data relating to the second image are written into the VRAM 23 instead of the color codes. In this case, the color video display apparatus 10 does not require the look-up table 36 (FIG. 7).

Figure 7:
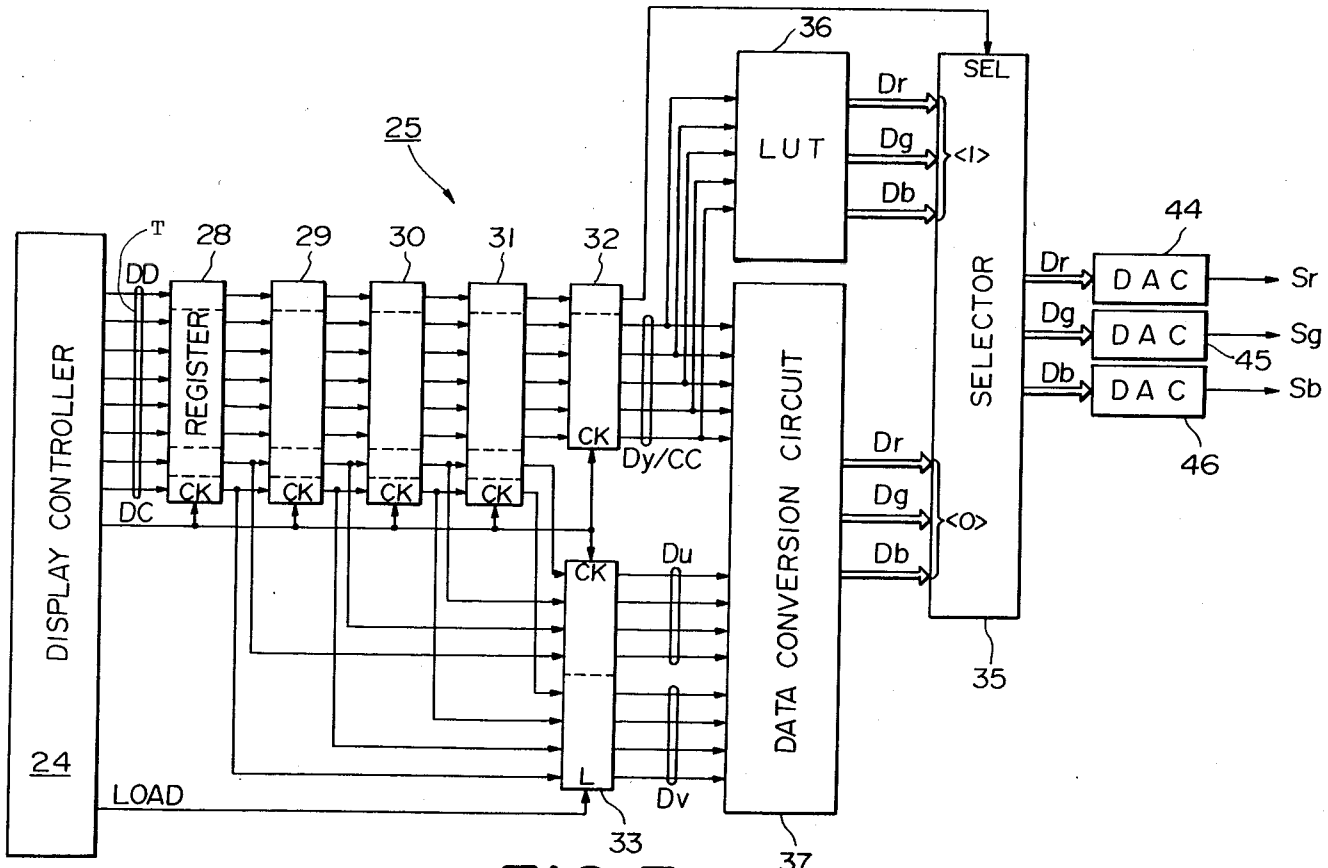
FIG. 7 is a detailed block diagram of the color signal generation circuit 25 of the color video display apparatus 10 of FIG. 3.
Figure 9:
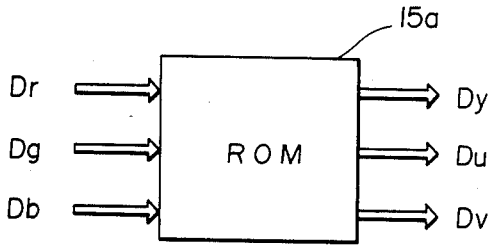
FIG. 9 is a block diagram of a modified form of the data conversion circuit 15 of FIG. 4.
Figure 10:
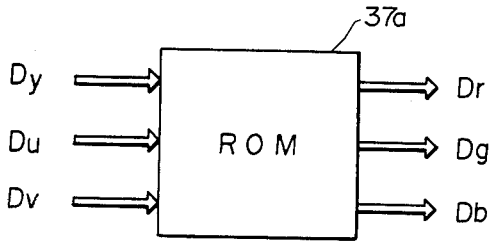
FIG. 10 is a block diagram of a modified form of the data conversion circuit 37 of FIG. 7.

Moreover, as shown in FIGS. 9 and 10, the data conversion circuit 15 of FIG. 3 and the data conversion circuit 37 of FIG. 7 can be replaced respectively by data conversion circuits 15*a* and 37*a* each constituted by a ROM. The color data Dr, Dg and Db are supplied to address input terminals of the data conversion circuit 15*a*, and the luminance data Dy and the color difference data Du and Dv are supplied to address input terminals of the data conversion circuit 37*a*. The data conversion circuits 15*a* and 37*a* of such construction, wherein ROMs are used, has the following advantages. Since the saturation of colors constituting a natural image is not high, the values of the color difference data Du and Dv substantially concentrates on "0" In the case where a ROM is used, a suitable selection of output data previously stored in the ROM enables such a non-linear data conversion to be performed that the resolution with respect to those input data in the vicinity of "0" is enhanced and that the resolution with respect to those input data other than the vicinity of "0" is lowered. In addition, it becomes possible to perform a normalization of data. Thus, by utilizing ROMs a color image can be displayed more accurately.

Figure 11:
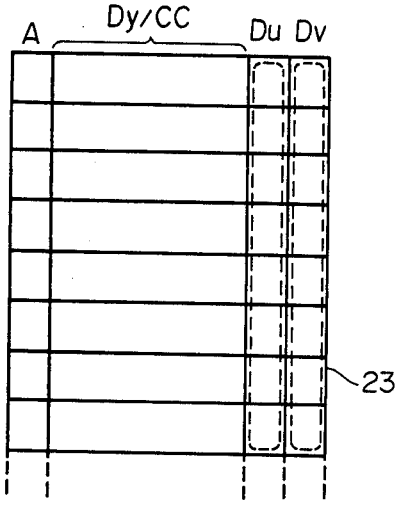
FIGS. 11 to 13 are illustrations showing other arrangements of the color difference data Du and Dv stored in the VRAM 23.
Figure 12:
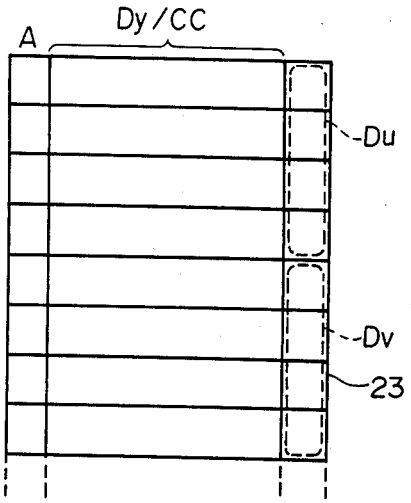
Figure 13:
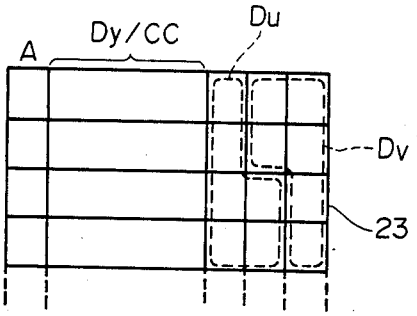

In the aforesaid embodiment, each of the color difference data Du and Dv is constituted by four bits and is stored in the VRAM 23 in accordance with the format shown in FIG. 5. Each of the color difference data Du and Dv may alternatively be constituted by eight bits and stored in accordance with the format shown in FIG. 11. In this case, four registers having the same construction as the registers 28 to 31 are additionally provided in the color signal generation circuit 25 of FIG. 7, and the register 33 is modified to have 16 bits. With this arrangement, each time eight pieces of dot display data DD are read out, the color difference data Du and Dv are transferred to the register 33. In the case where each of the color difference data Du and Dv is constituted by four bits, the color difference data Du and Dv may alternatively be stored in the VRAM 23 in the format shown in FIG. 12. In this case, each four-bit data constituted by the LSBs of the registers 28 to 31 is transferred alternately to the higher-order four bits of the register 33 and the lower-order four bits of the same register 33. Each of the color difference data Du and Dv may alternatively be constituted by six bits and stored in the VRAM 23 in accordance with the format shown in FIG. 13.

What is claimed is:

1. A color display apparatus for displaying a color image composed of a plurality of display dots on a screen of a display unit comprising:

(a) video information storage means having a plurality of memory locations each corresponding to a respective one of the plurality of display dots; each of said memory locations storing first display information or second display information each relating to a respective one of the display dots, and attribute information representing whether said first or second display information is stored in said memory locations; said plurality of memory locations being divided into a plurality of groups each composed of a predetermined number of memory locations for storing third display information relating to a corresponding number of said plurality of display dots;

(b) reading means for sequentially accessing said plurality of memory locations in synchronism with display timings of said display dots to read from each of th plurality of memory locations information stored therein;

(c) color data generating means responsive to each information read by said reding means for generating color data representative of a color of the corresponding display dot based on said first and third display information contained in said read information when the attribute information of said read information represents said first display information, said color data generating means generating said color data based on said second display information contained in said read information when the attribute information of said read information represents said second display information; and (d) signal feeding means for feeding a signal corresponding to said color data to the display unit.

2. A color video display apparatus according to claim 1, wherein said color data generating means comprises:

a register group having registers not less in number than said predetermined number for storing the predetermined number of said information most lately read by said reading means from said memory locations;

first temporary storage means for storing said third display information contained in said predetermined number of said information stored in said register group each time said predetermined number of said information are read from said memory locations;

first conversion means for converting the information contained in a specific one of registers of said register group and said third display information stored in said first temporary storage means into first color information; and data selection means for outputting said first color information as said color data when the attribute information contained in said specific register of said register group represents said first display information, said data selection means outputting the second display information contained in said specific register of said register group when the attribute information contained in said specific register represents said second display information.

3. A color video display apparatus according to claim 2, wherein said color data generating means further comprises second conversion means for converting the information contained in said specific register into second color information, said data selection means outputting said second color information as said color data when the attribute information contained in said specific register represents said second display information.

4. A color video display apparatus according to claim 2, wherein each of said first display information includes luminance information representative of a luminance of the corresponding display dot, each of said second display information including primary color information representative of three primary colors of the corresponding display dot, each of said third display information including color difference information representative of an averaged color difference of the predetermined number of display dots of the corresponding group.

5. A color video display apparatus according to claim 3, wherein each of said first display information includes luminance information representative of a luminance of the corresponding display dot, each of said second display information including a color code representative of a color of the corresponding display dot, each of said third display information including color difference information representative of an average color difference of the predetermined number of display dots of the corresponding group, said second conversion means comprising a look-up table for converting said color code into said color data.

6. A display control circuit for use with a display unit which displays a color image composed of a plurality of display dots on a screen thereof in response to display signals formed in accordanc with color data comprising:

(a) an input terminal for being sequentially supplied, in synchronization with display timings of the display dots, display data each of which includes first display information or second display information each relating to a respective one of the display dots, and attribute information representing whether said display data is said first display information or said second display information, said first display information including a first part of first information, the first information relating to a plurality of display dots and having a plurality of parts and said first part relating to said respective one of the display dots, and second information relating to said respective one of the display dots;

(b) a register group including a plurality of registers of respectively storing, in synchronization with said display timings, a predetermined number of said display data supplied to said input terminal;

(c) temporary storage means for storing said first information contained in said register group each time the plurality of parts of said first information are stored in said register group;

(d) first conversion means for converting said second information contained in a specific one of said registers of said register group and said first information stored in said temporary storage means into first color information; and (e) data selection means for outputting said first color information as said color data when said attribute information contained in said specific register represents said first display information, and for outputting said second display information contained in said specific register when said atrribute information contained in said specific register represents said second display information.

7. A display control circuit according to claim 6 further comprising second conversion means for converting said second display information contained in said specific register into second color information, and wherein said data selection means outputs said second color information as said color data when said attribute information contained in said specific register represents said second display information.

8. A display control circuit according to claim 6, wherein each of said first information includes color difference information representative of an averaged color difference of a plurality of display dots, each of said second information including luminance information representative of a luminance of a respective one of the display dots, each of said second display information including data representative of one of three primary colors of a respective one of the display dots.

9. A display control cirucit according to claim 7, wherein each of said first information includes color difference information representative of an average color difference a plurality of display dots, each of said second information including luminance information representative of a luminance of a respective one of the display dots, each of said second display information including a color code representative of a color of a respective one of the display dots, said second conversion means comprising a look-up table for converting said color code into said color data.

* * * * *

UNITED STATES PATENT AND TRADEMARK OFFICE

CERTIFICATE OF CORRECTION

PATENT NO. : 4,789,854

DATED : December 6, 1988

INVENTOR(S) : Takatoshi Ishii

It is certified that error appears in the above-identified patent and that said Letters Patent is hereby corrected as shown below:

Col. 9, line 45, after "said", change "reding" to --reading--.

Col. 10, line 51, after "in", change "accordanc" to --accordance--.

Col 12, line 15, after "an", change "average" to --averaged--.

Col. 12, line 16, after "difference", insert --of--.

Signed and Sealed this

Twentieth Day of March, 1990

*Attest:*

*Attesting Officer*

JEFFREY M. SAMUELS

*Acting Commissioner of Patents and Trademarks*